United States Patent [19]

Besson

[11] 4,196,578

[45] Apr. 8, 1980

[54] ELECTRO-MECHANICAL WATCH

[75] Inventor: René Besson, Neuchâtel, Switzerland

[73] Assignee: Ebauches S.A., Neuchatel, Switzerland

[21] Appl. No.: 877,859

[22] Filed: Feb. 15, 1978

[30] Foreign Application Priority Data

Feb. 22, 1977 [CH] Switzerland ..... 2176/77

[51] Int. Cl.[2] ..... G04C 3/00; G04B 19/24; G04B 27/00

[52] U.S. Cl. ..... 368/188; 368/34; 368/321

[58] Field of Search ..... 58/4 A, 23 R, 23 D, 58/23 A, 58, 85.5

[56] References Cited

U.S. PATENT DOCUMENTS 3,901,022 8/1975 Cleusix et al. ..... 58/23 R 3,998,044 12/1976 Yamauchi et al. ..... 58/23 R

*Primary Examiner*—Edith S. Jackmon

*Attorney, Agent, or Firm*—Silverman, Cass & Singer, Ltd.

[57] ABSTRACT

An electro-mechanical watch for advancing the uncorrected watch indicating members to their correct time indicating positions, after a correction period during which one of the indicating members is adjusted and the advancement of the uncorrected members is interrupted. In regular operation, a pulsed signal at a normal frequency from a watch frequency divider drives a stepping motor to advance the indicating members. At the beginning of the correction period, the pulsed signal is switched from the stepping motor to a pulse counter which counts the pulses occurring during the correction period. After the correction period, the pulsed signal is switched back to the stepping motor and a number of signal pulses at a higher than normal frequency, equal to the count of the pulse counter are applied to the stepping motor to advance rapidly the uncorrected indicating members to their correct time indicating positions.

4 Claims, 4 Drawing Figures

ELECTRO-MECHANICAL WATCH

BACKGROUND OF THE INVENTION

The present invention relates to an electromechanical watch including a time base, a frequency divider, a stepping motor driving the indicating members of the watch, a maintaining circuit for the motor controlled by the frequency divider, and correcting means manually operated by way of a control member, allowing action on some of the indicating members.

Such watches are known. The above mentioned correcting means allow, for instance, action on only the date indicating member, or else only on the hour indicating member, without modifying the position of any other indicating member. This provides the user with the possibility of correcting the indication of the date after months having thirty days, or of correcting the indication of the time when travelling and passing from one time zone to another. In the last case, the correcting means are generally arranged in such a way as to allow the advance of the hour indicator step by step at the rate of one hour for each step.

The drawback of such watches lies in the fact that the indicating members, of the minute and of the second, for instance, do not occupy a position which is absolutely exact after the correction of the hour indicator which is particularly disagreeable in the case of electronic watches, the precision of which is such that one desires not to lose either the exact minute, or the exact second.

The purpose of the present invention is to overcome this drawback by furnishing overtaking means which causes the indicating members of the watch to resume, after their correction, a position corresponding exactly to the actual time, the watch being stopped during the correction period.

SUMMARY OF THE INVENTION

The electro-mechanical watch according to the invention is characterized by the fact that it includes a pulse counter, and a switching device controlled by the control member which is arranged to interrupt the pulsing of the stepping motor and to direct to the counter the pulses coming from the frequency divider during the correction period. A logic circuit controls a maintaining circuit for the motor and is arranged in such a way that, when the correcting operation is ended, the motor is then driven at a speed higher than its normal speed a number of steps equal to the number of pulses the counter has received, which restores the normal state of the indicating members, and compensates for the loss of steps occuring during the correction period.

BRIEF DESCRIPTION OF THE DRAWINGS

The drawing shows, by way of example, one embodiment of the invention.

DESCRIPTION OF THE PREFERRED EMBODIMENT

Figure 1:
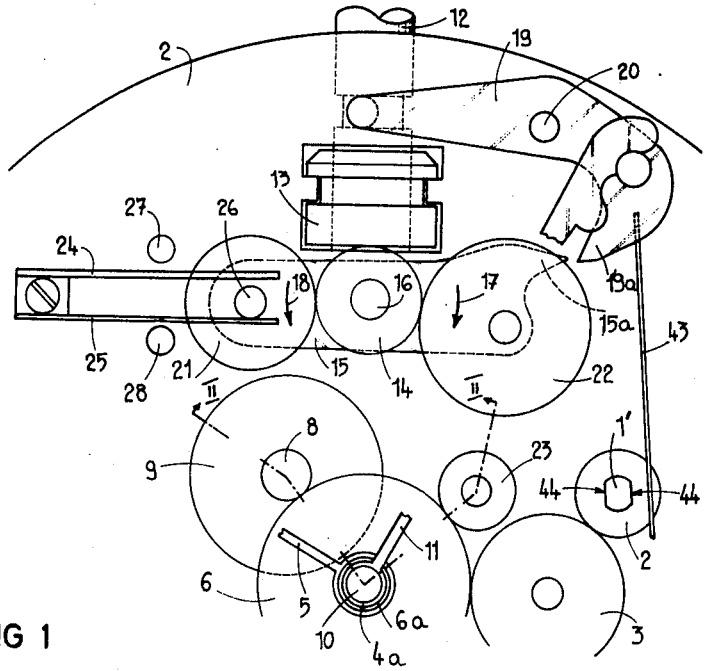
FIG. 1 is a diagrammatic plan view of a portion of an electro-mechanical watch showing its control mechanism which allows the conventional setting of the watch and the correction of the hour indicator only.
Figure 2:
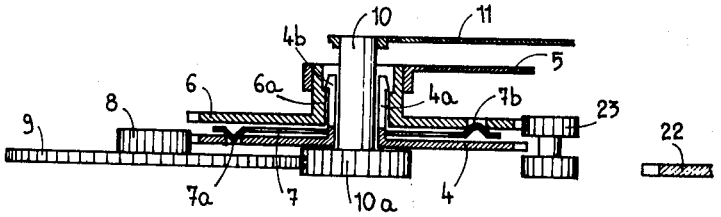
FIG. 2 is a sectional view of a detail, along line II—II of FIG. 1.

The watch represented in the drawing includes an electric stepping motor 1, only the shaft 1' of which, has been represented in FIG. 1. This motor drives, by the intermediary of two wheels 2 and 3, an hour cannon wheel 4 in FIG. 2. The hour hand, designated by 5, is not mounted directly on the hour cannon wheel 4, as in conventional constructions, but on a cannon *6a* of a supplementary cannon wheel 6 which is itself engaged on a cannon *4a* of the hour cannon wheel 4. The cannon *4a* is axially split, so as to be resilient, and has, at its end, an outer shoulder *4b* cooperating with an inner shoulder of the cannon *6a* for maintaining the wheel 6 in place. A resilient washer 7 is interposed between the wheels 4 and 6 and is provided with protrusions *7a* directed towards the wheel 4 and with protrusions *7b* directed towards the wheel 6. The protrusions *7a* engage holes of the wheel 4 while the protrusions *7b* engage holes of the wheel 6. This resilient washer 7 thus ensures the angular connection between the wheels 4 and 6. The frusto-conical shape of the protrusions *7a* have the effect that, when the torque to be transmitted between these two wheels goes beyond a predetermined value, the protrusions *7a* leave the holes of the wheel 4 and a slipping movement occurs. The wheel 4 is meshed with a pinion, designated by 8, of a dial-train the wheel of which, designated by 9, is meshed with a pinion *10a* of the cannon-pinion, designated by 10, carrying the minute hand 11 in FIG. 2.

The watch as represented includes a control stem 12 in FIG. 1 which is able to occupy two axial positions, pushed and pulled. Stem 12 when pushed, as represented in the drawing, selects the function it is desired to be effected and when pulled, effects the selected function. As represented in the example, the stem 12 in the pulled position, is able to effect two functions, i.e. on one hand the conventional setting of the time indicating members, such as the hour hand 5 and minute hand 11, or even the second hand, and on the other hand the driving or setting of the hours-hand 5 only.

To effect these two functions, the stem 12 carries a pinion 13 meshing with an intermediate pinion 14 frictionally mounted on a rocking lever 15, and coaxial with an axis 16 of the articulation of this lever on the frame of the movement. Hence, when the stem 12 occupies its pushed position, represented in FIG. 1, a rotation of stem 12 in one direction or the other causes the lever 15 to rotate in one direction or the other, as indicated by arrows 17 and 18, which produces the selection of the desired function.

When the stem 12 is pulled, it brings a beak or finger *19a* of a setting lever, 19, which is articulated at 20 on the frame of the movement, to come in front of or behind a beak or finger *15a* of the lever 15, thus maintaining lever 15 in the selected position.

The lever 15 carries two intermediate pinions 21 and 22 meshing with the intermediate pinion 14.

Depending on the selection which has been made when stem 12 is in the pushed position, one or the other of the two following situations occurs:

(a) The intermediate pinion 21 is meshing with the wheel 9 of the dial-train which is itself meshing with teeth *10a* of the cannon pinion 10. Hence, the rotation of the stem 12, in one direction or the other, allows one to effect the conventional setting of the time indicating members, such as the hour hand 5 and the minute hand 11, or even the second hand; and (b) The intermediate pinion 22 is meshing with the lower portion of a double intermediate pinion 23 the upper portion of which is meshing with the supplementary hour cannon wheel 6 carrying the hour hand 5. The rotation of the stem 12 then allows one to act only on the hour hand, without moving the minute hand or the second hand.

Because the protrusions 7*a* of the resilient washer 7 ensure the driving of the wheel 4 by the wheel 6, the driving of the hour hand only is effected step by step, at the rate of one hour for each step. Such mechanisms are known per se, one of them appearing, for instance, in the Swiss Pat. No. 571,736.

The lever 15 is moreover acted on by two return blade springs 24 and 25 cooperating with the shaft, 26 of the intermediate pinion 21, and which springs tend to maintain lever 15 in its rest position as represented in FIG. 1. When the lever 15 occupies one or the other of its two working positions, one or the other of the springs 24 and 25 is resiliently deformed. When spring 24 is deformed, it comes into contact with a pin 27, and when spring 25 is deformed it comes into contact with a pin 28. The elastic spring 24 and pin 27, elastic spring 25 and pin 28 constitute respectively, switches 24–27 and 25–28.

Figure 3:
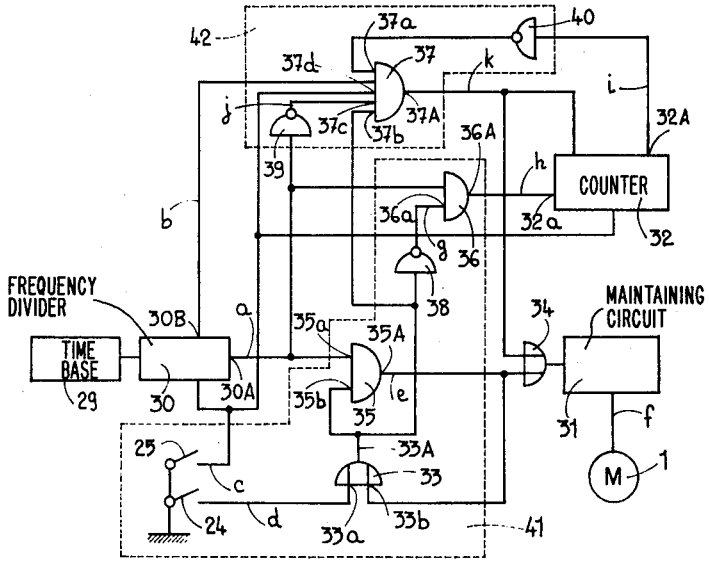
FIG. 3 is a diagram of the electronic circuit of this watch.

The electronic circuit represented in FIG. 3 includes a time base 29 constituted for example, by a piezo-electric resonator, a frequency divider 30, a maintaining circuit 31, the motor 1, a counter 32, the two switches 24–27 and 25–28, two OR gates 33 and 34, three AND gates 35, 36 and 37, and three inverters 38, 39 and 40. The elements contained in the block indicated by 41 constitute a switching circuit, while those contained in the block indicated by 42 constitute a logic circuit.

In normal operation, the frequency of the output signal of the time base 29 is divided by the divider 30, the frequency of the output 30A of this divider being applied to the input 35*a* of the AND gate 35. Since the input 35*b* of the AND gate 35 is at the logic state 1, because the switches 24–27 and 25–28 are open, the output signal of the divider 30 is gated to the output of AND gate 35. This signal is applied to the maintaining circuit 31 through the OR gate 34. The maintaining circuit 31 produces from this signal shaped pulses which maintain or drive the motor 1. The other elements of the circuit then do not play any role. One may determine, indeed, that the AND gate 36 is locked or disabled and will not pass any pulses as a result of the switch 24–27 being open, which causes the input 33*a* and output 33*a* of the OR gate 33 to be at the logic state 1, which causes, due to the inverter 38, the input 36*a* of the AND gate 36 to be at the logic state 0. The input 32*a* of the counter 32 does not therefore receive any pulsed signal. When the count of counter 32 is zero, its output 32A is at the logic state 1. Due to the inverter 40, the input 37*a* of the AND gate 37 is at the logic state 0, so that this gate is also disabled.

If one effects a correction of the hour hand, as a result in a change in the time zone, for instance, one closes the switch 24–27, as indicated previously. The input 33*a* of the OR gate 33 is then at the logic state 0. If, at this moment, the divider 30 emits a pulse, the input 33*b* of the OR gate 33 is at the logic state 1 up to the end of this pulse. The output 33A then passes to the logic state 0, which brings the input 36*a* of the AND gate 36 to the logic state 1 due to the inverter 38. In this way, each time a pulse is emitted from the frequency divider 30, it is passed to the output 36A of the AND gate 36, wherefrom it increments the counter 32. The AND gate 37 remains disabled as a result of its input 37*b* being at the logic state 0. The AND gate 35 is also disabled as a result of its input 35*b* being at the logic state 0. When, at the end of the correction period, the switch 24–27 is re-opened, the input 33*a* of the OR gate 33 passes to the logic state 1. Consequently, the AND gate 35 is enabled to allow passage of the pulses coming from the frequency divider 30. The output 32A of the counter 32 is no longer at the logic state 1 since the content of this counter is not zero. The input 37*a* of the AND gate 37 is at the logic state 1. The input 37*b* is at the logic state 1 since the switch 24–27 is open. As long as the divider 30 does not emit a pulse, the input 37*c* of the AND gate 37 is also at the logic state 1, due to the inverter 39. The switch 25–28 being also open, the input 37*d* of the AND gate 37 is at the logic state 1. In this way, pulses coming from an intermediary output 30B of the frequency divider 30 are passed to the output 37A of the AND gate 37. On one hand, the pulses from output 37A are subtracted from the content or count of the counter 32, and on the other hand, they are applied to the driving circuit 31 of the motor through the OR gate 34. The pulses from the output 37A are of higher frequency than those coming from the output 30A of the divider 30 which cause the motor 1 to advance at a speed higher than its normal speed, which compensates for the lack of advancement of the indicating members of the watch occuring during the correction period. If, during this compensation period, the divider 30 delivers a pulse through its output 30A, the input 37*c* of the AND gate 37 passes to the logic state 0, in such a way that a pulse coming simultaneously from the output 30B of the divider 30 is not passed to the output 37A of the AND gate 37. Consequently, the pulse from output 30A does not act on the counter 32, but it is passed to the output 35A of the AND gate 35, so that it acts on the maintaining circuit 31. When the counter 32 again has a count equal to zero, its output 32A passes to the logic state 1, which brings the input 37*a* of the AND gate 37 to the logic state 0, due to the inverter 40. The watch then resumes its normal running or operation.

If the user wants to effect the conventional setting of the watch, he closes, during the manipulation, the switch 25–28, which is the usual switch for electromechanical watches. Therefore, during conventional setting, the motor is stopped, its pulsing being interrupted, and the divider is brought back to zero, so that, when the stem is pushed into its rest position, the motor starts after a time equal to one step, which moves the second hand, at the desired time.

The closing of the switch 25–28 has the effect of resetting to zero the divider 30 and the counter 32. The motor 1 is no longer driven. The input 36*a* of the AND gate 36 is also at the logic state 0. Consequently, the input 32*a* of the counter 32 does not receive any signal. During this period, there is no action, either on the motor, or on the counter. The closing of the switch 25–28 has a further effect of resetting to zero the divider 30 and the counter 32 in such a way that, when the user, after having ended the setting of the watch, pushes the control stem 12, the watch starts again normally.

It is to be noted that, so as to ensure the stability of the positions of the rotor of the motor when the switch 25–28 is closed, the setting lever 19 carries a resilient whip 43 (FIG. 1) which cooperates, when the stem 12 is in its pulled position, with one or the other of two flat surfaces 44 of the shaft 1 of the motor.

Figure 4:
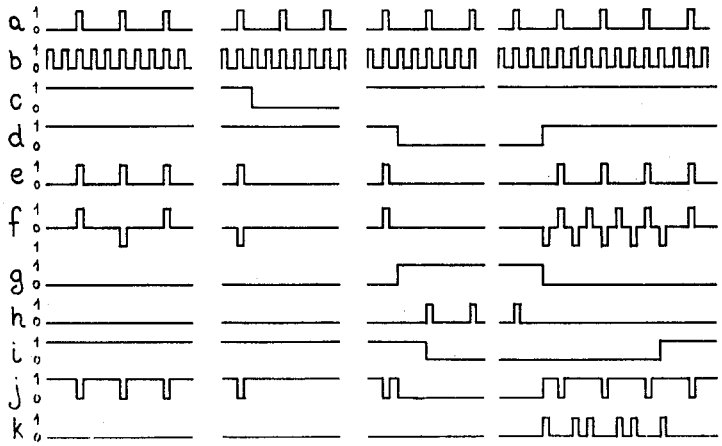
FIG. 4 is a diagram showing the state of different points of the circuit of FIG. 3.

FIG. 4 shows the state of different points of the circuit of FIG. 3:

Line a corresponds to the output 30A of the divider 30; line b corresponds to the output 30B of the divider; line c corresponds to the output of the switch 25; line d corresponds to the output of the switch 24; line e corresponds to the output 35A of the AND gate 35; line f indicates the pulses applied to the motor 1; line g corresponds to the input 36*a* of the AND gate 36; line h corresponds to the input 32*a* of the counter 32; line i corresponds to the output 32A of the counter 32; line j corresponds to the input 37*c* of the AND gate 37; line k corresponds to the output 37A of the AND gate 37.

What I claim is:

1. An electro-mechanical watch for advancing indicating members of the watch to display the correct time after a correction period in which the position of at least one of the indicating members is adjusted, said watch comprising: generator means for generating a high frequency pulsed signal and a normal lower frequency pulsed signal, stepping motor means coupled to one of said pulsed signals for advancing said indicating members at a normal time indicating speed in response to said normal signal and at a faster than normal speed in response to said high frequency signal, maintaining circuit means coupled between said generator means and said motor means for driving said motor means in response to said pulsed signals, correction means coupled to said indicating members for adjusting at least one of said indicating members during said correction period in response to a control member of the correction means being manually operated, pulse counter means coupled to said generator means for producing a count of said normal signal pulses during said correction period, switch means coupled to said control member for switching said normal signal from said maintaining means to said pulse counter means during said correction period in response to said control member being operated, and logic circuit means for applying to said maintaining means a number of pulses of said high frequency signal equal to said count after the end of the correction period to advance at a speed faster than normal said indicating members to a position to display the correct time.

2. An electro-mechanical watch as claimed in claim 1 in which said generator means include time base means for producing a time base signal, and frequency divider means coupled to said time base signal for producing said pulsed signals, there being an intermediate stage of said divider means between said time base signal and said normal signal which produces said high frequency signal.

3. An electro-mechanical watch as claimed in claim 1 in which said control member is manually operable between a pushed position and a pulled position, said control member in said pulled position being able to operate said correction means, said switch means switching said normal signal from said maintaining means during the passage of the control member from its pushed to pulled position and switching said normal signal back to said maintaining means during the passage of the control member from its pulled to pushed position.

4. An electro-mechanical watch as claimed in claim 1 in which said correction means include a rocking lever which is moved by said control member against the force of a blade spring which tends to maintain said lever in its rest position, said blade spring forming a contact element of an electric switch of said switch means which controls said switch means.

* * * * *